US008403649B2

(12) United States Patent
Sanger et al.

(10) Patent No.: US 8,403,649 B2
(45) Date of Patent: Mar. 26, 2013

(54) DIGITAL CONTROL DEVICE

(75) Inventors: Joe Sanger, Los Angeles, CA (US); Forrest Hudson, Corvelius, OR (US); Warren Faler, Garden Grove, CA (US)

(73) Assignee: Multiquip, Inc., Carson, CA (US)

( * ) Notice: Subject to any disclaimer, the term of this patent is extended or adjusted under 35 U.S.C. 154(b) by 1067 days.

(21) Appl. No.: 12/016,117

(22) Filed: Jan. 17, 2008

(65) Prior Publication Data

US 2009/0185915 A1 Jul. 23, 2009

(51) Int. Cl.
*F04B 49/00* (2006.01)

(52) U.S. Cl. ..... 417/46; 417/900

(58) Field of Classification Search ..... 417/46, 417/900

See application file for complete search history.

(56) References Cited

U.S. PATENT DOCUMENTS 3,682,575 A * 8/1972 Guddal et al. ..... 417/517
3,955,130 A 5/1976 Graf
4,084,204 A 4/1978 Jacobus, Jr.
4,473,856 A 9/1984 Takahashi et al.
5,238,371 A * 8/1993 Benckert ..... 417/345
5,592,353 A 1/1997 Shinohara et al.
5,592,355 A 1/1997 Ikkai et al.
5,675,231 A 10/1997 Becerra et al.
5,684,371 A * 11/1997 Tarui et al. ..... 318/400.29
6,177,774 B1 1/2001 Iwashita et al.
6,240,336 B1 * 5/2001 Brundisini ..... 700/284
6,324,038 B1 11/2001 Kishibe et al.
6,440,039 B1 8/2002 Warren
6,443,718 B1 9/2002 Vincent
2001/0019470 A1 9/2001 Hiwatari et al.

* cited by examiner

*Primary Examiner* — Charles Freay
*Assistant Examiner* — Patrick Hamo
(74) *Attorney, Agent, or Firm* — Frank J. Dykas; Scott D. Swanson; Dykas & Shaver

(57) ABSTRACT

A digital control system for monitoring and controlling a concrete pumping system. A microcontroller provides control signals and receives feedback from associated comparator switch subsystems. Feedback from the comparator switch subsystems is used by a microcontroller to determine whether short circuit or open circuit malfunctions are occurring on solenoids valves attached to the output of the comparator switch subsystems. Said control system exhibits an electronic control means to control the admittance or interruption of current through said solenoids. Individual solenoid status is sent to a graphical display where an operator views said display to diagnose failure modes. The microcontroller further monitors the establishment of temporal initial conditions and limits operational pump activity until said temporal conditions are met.

13 Claims, 3 Drawing Sheets

DIGITAL CONTROL DEVICE

FIELD OF THE INVENTION

The invention generally relates to an automated monitoring control system for a hydraulic driven pump, and more particularly to a hydraulic driven concrete pump used to pump concrete at a job site. The system monitors current flow to various solenoids and valves in the hydraulic drive to provide immediate diagnostic information, and sends control signals to the solenoids and valves based upon the monitored condition.

BACKGROUND OF THE INVENTION

In the concrete delivery industry, delivery of concrete to the job site often requires the delivery vehicle to be at a much different lateral distance and/or elevation than a particular region of the site that is to receive concrete. To overcome this obstacle concrete placement pumps are often employed to move the concrete over the distance required.

Within these concrete placement pumps, the concrete is pumped through a long tube affixed to the outlet of concrete placement pump moved to the delivery area for the concrete. To transport concrete through the steel tubing or hoses over the distance needed, large hydraulically driven piston pumps are used.

One of the most common modes of failure for the concrete trucks is an obstruction in the concrete pumping line. When an obstruction, occurs the system ceases to operate and no longer expels concrete to the region of interest. Unfortunately this effect behaves identically to other failure modes. If one of the controlling solenoids within the hydraulic drive develops a fault and no longer operates as desired, the drive will no longer be able to push the concrete pump. Once a failure mode occurs the crew must wait for a technician to arrive on the jobsite. Said technician can then begin troubleshooting this event to discover whether an obstruction in the line exists, or if the pumping system has a failed solenoid. Frequently, the issue is simply an obstruction; however time and resources are utilized to inquire the possibility of failed solenoid. Additionally, during time needed for the technician to arrive on site many times the concrete will harden causing serious damage to the concrete placement pump.

Oftentimes, the time required for an individual to reach the job site to troubleshoot and perform maintenance on the pumping system is too long. The concrete in the pump and the line will harden if left to sit too long. Once the concrete sets in this manner, the hardened concrete becomes incredibly difficult to remove. This costs a significant amount of time and recourses as well as the loss of time spent on the job site.

Another issue plaguing the concrete boom delivery industry is engine load during start up of the engine and on/off concrete pumping cycles during daily operation while concrete is in the pumping line. At start up, hydraulic loads on the engine can be very high. These loads can overtax the engine starter and engine battery capacity. In addition, during on/off concrete pumping cycles while equipment of the concrete hoses are being moved the engine RPM is reduced to idle speeds to increase engine longevity and reduce fuel consumption. When the concrete pump is actuated from these off cycles the loads are influenced by latent pressure in the drive system and the inertia involved in moving concrete from a resting position. Often the latent loads are sufficient enough to cause the engine to lug or stall. Over time these loads on the engine can cause damage to the engine itself, requiring repair or replacement.

The operational theory of said concrete pumps is fairly simple, and most failures modes are caused by loose wiring connections, broken wires, or faulty solenoids. This allows troubleshooting of wiring circuits or the replacement of solenoids to be carried out by pump operators already on the job site. The difficult part of maintaining the pumps is troubleshooting and fault analysis, which often requires trained technicians. What is needed in the industry is a way to automate the troubleshooting process to allow personnel on-site to quickly establish the cause of a failed pump and carry out appropriate maintenance procedures before the concrete in the pump system hardens.

SUMMARY OF THE INVENTION

What is provided is a digital control system for monitoring and controlling a hydraulic driven concrete pump used to pump concrete at a job site. Currently, the ability to troubleshoot failed sub systems during operations of a pump requires a trained technician to make a service call. This may take too long as the concrete could set in the pump or tube and become hard. The current invention displays on an illuminated screen electric components, and wiring subsystems that are functioning improperly, which allows immediate diagnosis on the job site.

If all the subsystems are exhibiting no failure codes as provided by the display, an operator can assume there is a clog in the line. If the system does sense a malfunctioning wiring connection or solenoid, the solenoid and the solenoid's failure state will be apparent on the user's display. With this information, a pump operator can replace or reconnect the failed solenoid without the assistance of an on-site technician.

The system also reduces load on the engine driving the pump during startup. This minimizes the load on the engine starter and battery and therefore increases its operational lifetime. The system also delays the activation of the concrete placement pump when the engine is at idle allowing the engine to reach full RPM and maximum horsepower before the full load is applied the engine. This prevents engine lugging and sometimes engine stalling, thus increasing the engines operational life.

The objectives, features, and attendant advantages of the invention will become apparent as the invention becomes better understood by reference to the following detailed descriptions and accompanying drawings. The detailed description and drawings illustrate some, but not the only, embodiments of the invention.

BRIEF DESCRIPTION ON THE DRAWINGS

DESCRIPTION OF THE PREFERRED EMBODIMENTS

Figure 1:
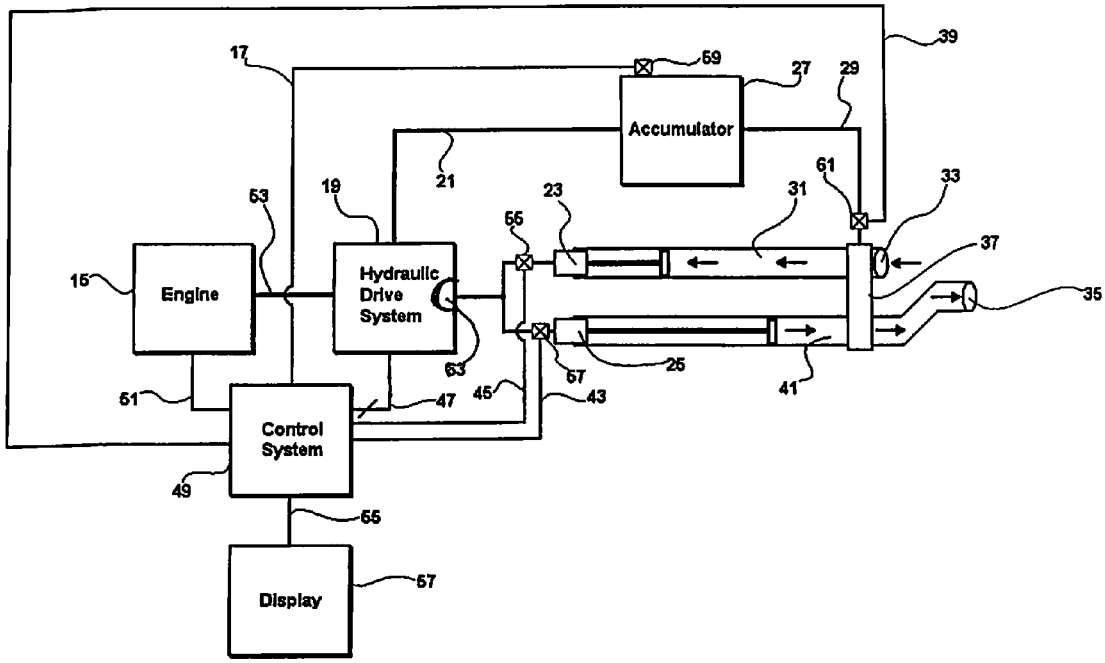
FIG. 1 shows an embodiment of the digital control system interfaced with a basic concrete pumping apparatus in schematic format.

While the invention is susceptible of various modifications and alternative constructions, certain illustrated embodiments thereof have been shown in the drawings and will be described below in detail. It should be understood, however, that there is no intention to limit the invention to the specific form disclosed, but, on the contrary, the invention is to cover all modifications, alternative constructions, and equivalents falling within the spirit and scope of the invention as defined in the claims.

To deliver concrete to a job site impassable by delivery trucks, concrete placement pumps are utilized. These pumps move concrete through a tube to the region to receive the concrete. To facilitate this pumping, hydraulically driven piston pumps flow oil through hydraulic valves which are controlled by electric solenoids. These hydraulically driven piston pumps exhibit many different failure modes in their lifetime. Of these failure modes, the most common is either a clog in the line or a failed solenoid. Both of these failure modes exhibit the same symptoms. A technician is required on-site to troubleshoot the failure mode to determine whether it is either a clog in the line or a failed solenoid. This creates a waste of time and resources to diagnose the issue. Another issue these concrete pumps face is high engine loads at start up. These engines loads are caused by latent pressure within the system that cause a load upon the piston pumps. Repetitious high-load startups can reduce the lifetime of the engine's starter motor and reduce battery life.

The current invention addresses these issues by monitoring and controlling the various solenoids and motors associated with a hydraulic drive system. The monitored status of the various solenoids are then displayed to a user in graphical format on a display screen. If a failure symptom occurs, the operator of the pump can then review the data display to determine the source of the failure. The display data will then inform the operator if the failure is the cause of a broken subsystem or a clog in the line.

If all the subsystems are showing no error messages, meaning none of the solenoids are exhibiting shorts or opens, then the result follows that there is a clog in the line. If the system does sense a malfunctioning solenoid, the solenoid and the solenoid's failure state will be apparent on the user's display.

The system also establishes initial conditions that must be met before activation of the pump. To reduce the engine starting load, the control system closes a motorized flow control valve and opens an actuator dump valve. This minimizes the load on the engine and therefore increases its operational lifetime and prevents high speed pumping of the concrete before the lines are filled with concrete. Most plugs of the concrete lines occur during this initial filling period.

In the following description and in the figures, like elements are identified with like reference numerals. The use of "or" indicates a non-exclusive alternative without limitation unless otherwise noted. The use of "including" means "including, but not limited to," unless otherwise noted.

FIG. 1 illustrates the digital control system of the current invention interfaced with a basic concrete pumping apparatus. Engine 15 provides power to hydraulic drive system 19 through drive line 53. Engine 15 also sends a signal to control system 49 when engine 15 is initialized, said signal is sent over engine to control system signal line 51. Digital control system 49 monitors and controls solenoids located in accumulator 27, shuttle 37, and piston assemblies 23 and 25.

Digital control system 49 further controls the motorized flow control valve 63. Hydraulic drive system 19 is configured to supply pressurized hydraulic fluid to accumulator 27 and piston assemblies 23 and 25 through hydraulic line assembly 21. In turn accumulator 27 supplies hydraulic pressure to shuttle 37 through accumulator to shuttle hydraulic line 29.

The magnitude of the hydraulic pressure actuating shuttle 37 and piston assemblies 23 and 25 is modulated by a motorized flow control valve 63. Said motorized flow control valve 63 controls the volume of hydraulic fluid incoming to hydraulic drive system 19. The more hydraulic fluid admitted into hydraulic drive system 19 by said motorized flow control valve 63, the higher the concrete pumping volume is. If less hydraulic fluid is admitted through said motorized flow control valve 63, then the concrete output of the pump decreases. Digital flow control system 49 actuates the position of the motorized flow control valve 63 through signal bus 47.

Accumulator 27 is configured to vent pressure to the hydraulic tank when the pump system is initialized. This is accomplished by a solenoid actuated accumulator dump valve 59. Digital control system 49 is configured to open said accumulator dump valve 59 by sending a signal on control system to accumulator signal line 17 upon engine 15 startup.

Piston assemblies 23 and 25 are hydraulically actuated with solenoid valves 55 and 57 controlled by control system 49. An activation or deactivation signal is sent to the solenoids 55 and 57 through control system to piston assembly solenoid lines 43 and 45. By actuating the hydraulic pressure to piston assemblies 23 and 25, said piston assemblies are configured to operate by moving in an opposing linear motion within piston tubes 31 and 41. For example, when piston assembly 23 is in a draw stroke and moving towards the closed end of piston tube 31, piston assembly 25 will be in a compression stroke pushing toward the open end of piston tube 41. Consequently when piston assembly 25 is in a draw stroke, piston assemble 23 will be in a compression stroke.

In a preferred embodiment, piston tube intake 33 is located in a hopper filled with concrete. When piston assemblies 23 or 25 are in a draw stroke, concrete is drawn into the piston tube associated with said piston assembly. Shuttle 37 is hydraulically actuated by a solenoid valve 37 controlled by control system 49 through control system to shuttle solenoid signal line 39. Control system 39 is configured to send a signal solenoid 61 to actuate shuttle 37 to align the pump output 35 to the cylinder tube that under a compression stroke. The aligning of shuttle 37 in this way exposes the opposite cylinder tube, which is under a draw stroke, to be exposed to a hopper full of concrete, in turn filling said tube under a draw stroke with concrete. Piston assemblies 23 and 25 along with shuttle 37 continuously cycle in this manner during operation, resulting in a continuous flow of concrete from pump output 35.

Status of the solenoid valves interfaced with said control system is displayed on display 57. Display 57 is configured so an operator will view said display to review the operational status of said concrete pump. If a solenoid valve is experiencing a malfunction, display 57 is configured to shows the actuation state of the solenoid, proximity sensor, or the particular malfunctioning solenoid/wiring system and said malfunctioning wiring/solenoid's mode of failure. These failure modes include short circuit, and open circuit malfunctions.

Figure 2:
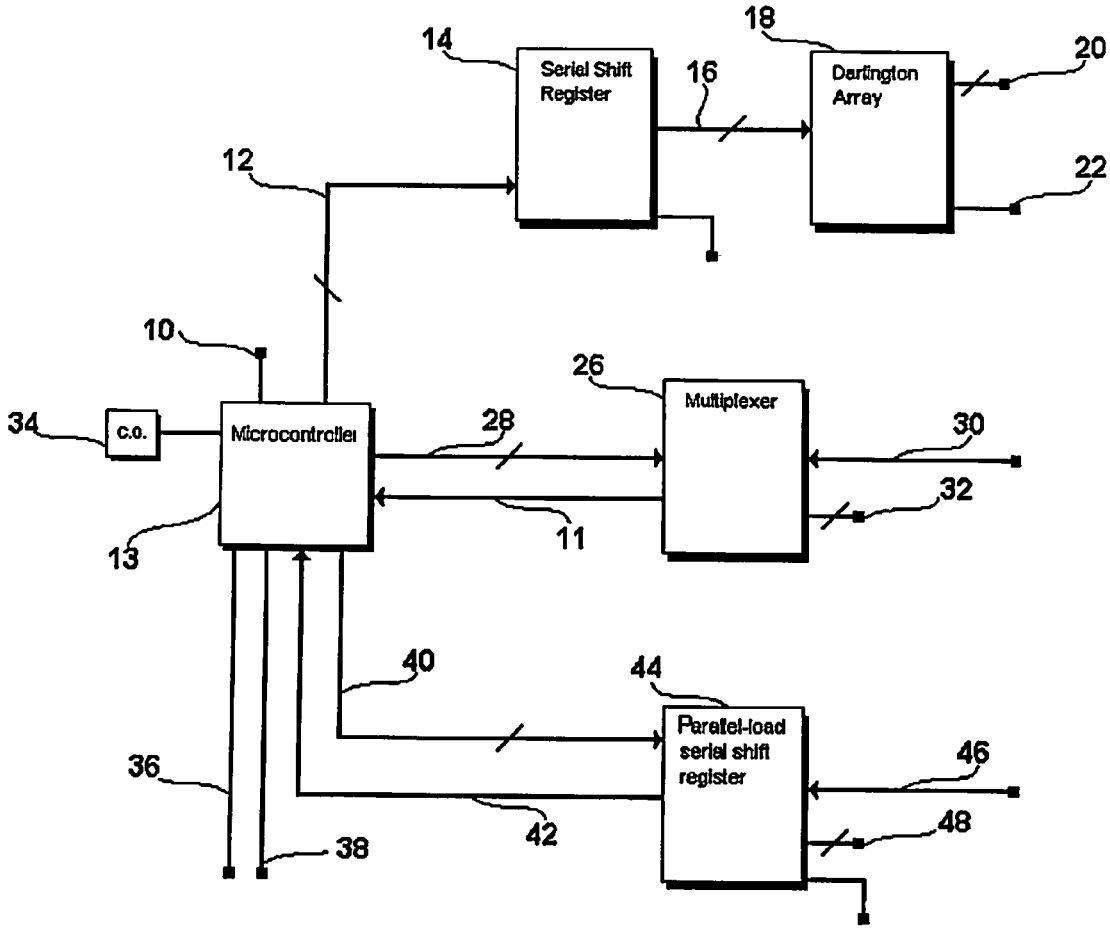
FIG. 2 shows an embodiment of the microcontroller subsystem of the invented digital control system in block diagram format.

FIG. 2 illustrates the microcontroller circuit sub-system of the current invention. Microcontroller 13 sends activation and de-activation signal data to the comparator switch circuit seen in FIG. 3. It is also configured to receive current and voltage feedback data from the comparator circuit seen on FIG. 3 and respond to said data. To send signal activation or de-activation data, microprocessor 13 sends the signal over microcontroller to load serial shift register signal bus 12 to serial shift register 14. Signal bus 12 also clock pulse signals to serial shift register 14 to load the various registers within the serial shift register, and send the data contained in those registers across serial shift register to Darlington array signal bus 16 to Darlington array 18. The serial activation or deactivation signal data is sent across signal bus 12 to serial shift register 14 on each corresponding clock pulse sent from microcontroller 13.

Each individual register contained in serial shift register 14 contains the signal data for each corresponding comparator switch. Serial bus 12 sends another bus clock pulse which commands the sending of parallel data from the serial shift register 14 to Darlington array 18 over serial shift register to Darlington array signal bus 16. Darlington array 18 has a plurality of outputs. Said Darlington array outputs are represented by Darlington array signal output bus 20 and Darlington array signal output to comparator switch line 22.

Figure 3:
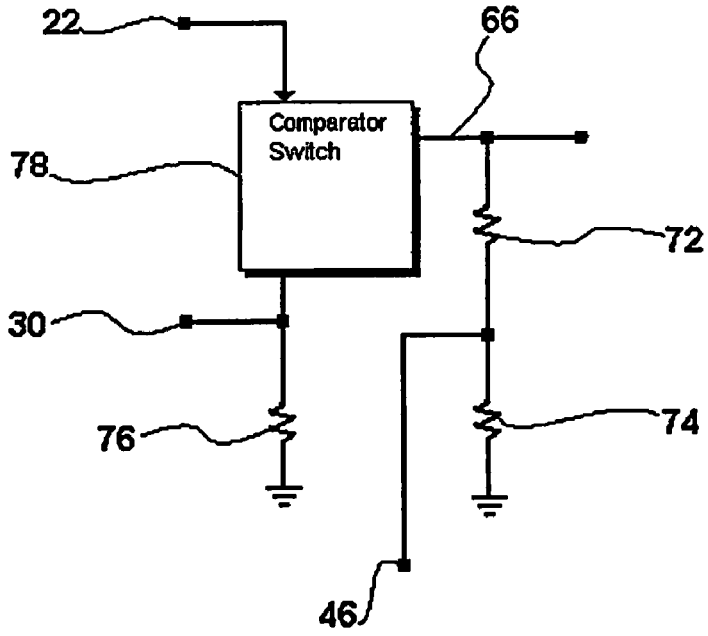
FIG. 3 shows an embodiment of a comparator switch circuit of the invented digital control system in block diagram format.

Output bus 20 represents a number of similar outputs that lead to various comparator switch circuits of the form as seen in FIG. 3. In this manner multiple comparator switch circuits as seen in FIG. 1 can be connected to microcontroller subsystem FIG. 2 to allow the monitoring and controlling of any number of solenoids.

FIG. 3 illustrates the comparator switch sub system of the current invention. The Darlington array signal output to comparator switch line 22 transmits the activation or deactivation signal to the comparator switch. Based upon this signal, the comparator switch generates voltage to comparator switch output 66 in turn providing the current needed to operate either an attached solenoid or a motor to the output line 66. The output current to solenoid valves is monitored by the microcontroller system and will automatically open the connection to the solenoid valve if a short is detected. If a short is detected, the microcontroller will further pass a signal to an attached display. Said display in turn presents a graphical interface for an operator, informing said operator that a particular solenoid valve is malfunctioning as well as displaying the mode of failure.

This comparator switch circuit of FIG. 3 provides an output for the load to the solenoid valve on the machine 60 and another much smaller output that is proportional to the load current. If the sense output goes over a predetermined level, the comparator switch shuts down. If this occurs, the microcontroller 13 will detect that it is commanding an output but the voltage feedback is not conforming to the output. This condition is interpreted as a short in the load by the microcontroller 13. In turn the microcontroller 13 will send a deactivate signal to a comparator switch. The voltage feedback is determined by voltage feedback resistors 72 and 74. The ratio to these resistors determines the level of voltage feedback to the microcontroller 13. The microcontroller 13 responds to this given feedback by comparing it to predetermined levels programmed in said microcontroller 13.

Microcontroller 13 detects if an open circuit or an incomplete electrical flow path exists from the microcontroller 13 to a solenoid valve and then to ground. When this open circuit is detected an error message will be displayed on display 57 indicating that there is an open circuit for that specific solenoid wiring loop. The system achieves this feature by further using the comparator switch sub assembly FIG. 3. Comparator switch 78 in the preferred embodiment is an IR3315 integrated circuit. The comparator circuit provides an output for the, load being a solenoid valve or motor, and another much smaller output that is proportional to the load current. The output proportional to a load current is provided on current feedback signal to multiplexer line 30. This proportional voltage can be adjusted by selecting various values for resistor 76, in this case to 1.5K ohm. Since this sense output is proportional to the load, it is monitored by the microcontroller as an analog value. If the microcontroller commands an output and the monitored current feedback is to low an open circuit error is reported. This open circuit malfunction will be displayed on the graphical display to the operator designating the particular solenoid loop that is failing.

The open circuit feedback signal is sent on current feedback signal to multiplexer line 30 to multiplexer 36. Multiple comparators switch circuits operating multiple solenoid valves and motors also have their current feedback signal sent to multiplexer 26 through multiplexer current feedback bus 32. Microcontroller 13 polls the parallel data being sent to multiplexer 26 through microcontroller to multiplexer signal bus 28. This parallel data is then sent serially through multiplexer to microcontroller signal bus line 11, depending on the corresponding signal pulled by microcontroller 13. Data indicating a short is sent to microcontroller via voltage feedback to parallel load serial shift register line 46.

Multiple comparator switch circuits as seen in FIG. 3 can also have their voltage feedback line connected to parallel load serial shift register voltage feedback bus 48, thus multiple solenoid valves are monitored and controlled in this configuration. Microcontroller 13 sends clock pulse signal data to parallel load serial shift register 44 via microcontroller to parallel load signal shift register bus 40. On said clock pulse the data is loaded from the input to the parallel load signal shift register line 46 and bus 48 to the registers within the serial shift register. Parallel data from line 46 and bus 48 is sent over parallel load serial shift register 44 to microcontroller 13 over parallel load serial shift register to microcontroller signal line 42. This data is constantly polled and reviewed by microcontroller 13. When a short circuit signal malfunction has been read from the parallel load serial shift register 44 microcontroller 13 will then send this information to display 57 via microcontroller to display line 10 to allow the operator of the device to diagnose the malfunction of that particular solenoid valve as a short.

Figure 4:
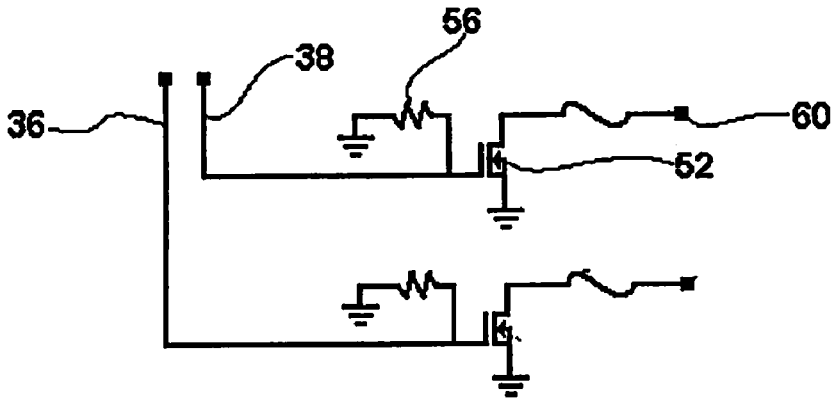
FIG. 4 shows an embodiment of a motorized flow control circuit of the invented digital control system in block diagram format.

FIG. 4 is an illustration of the motorized flow control circuit of the current invention. The microcontroller 13 also controls the operation of the motorized flow control valve 63. Said motorized flow control valve controls the amount of hydraulic fluid flowing into the hydraulic drive system 19, thus controlling the amount of power delivered to the connected concrete pump. Microcontroller 13 energizes the motorized flow control valve 63 to close for eight seconds whenever the microcontroller 13 is initially energized. Microcontroller 13 further energizes the motorized flow control valve 63 to close whenever the starter solenoid of the engine is activated. Motorized flow control valve 63 further has an end of stroke switch which internally disengages power to said motorized flow control valve 53 when it reaches its full closed position.

Closing the motorized flow control valve upon activation reduces the horse power drag on the engine during start up conditions. Microcontroller 13 achieves this feature by an internally timer that increments by every one millisecond. Upon initial power up, the microcontroller energizes the microcontroller to motorized flow signal line 38 and a comparator switch circuit as seen in FIG. 3 whose output is connected to node 60 which allows current to pass through the flow motor. Activation signal on line 38 activates the transistor 52 which allows current flow from the comparator switch to node 60 through the motor into ground, activating the flow motor. The motor in turn closes said motorized flow control valve. When the timer in the microprocessor reaches 8,000 milliseconds (eight seconds) the microcontroller de-energizes line 38 and the comparator switch whose output is connected to node 60, which stops motorized flow control valve 63.

Microcontroller 13 de-energizes the normally opened accumulator dump valve solenoid 59 for three seconds whenever the starter solenoid of the engine is energized. This release of latent pressure within the accumulator reduces horse power drag on the engine during start up. Said microcontroller 13 accomplishes this feature by an internal timer that increments by every millisecond. Said microcontroller 13 monitors a start wire voltage on line 51. When it detects voltage on said line, it sets the timer to zero the code and de-energize the comparator switch circuit as seen in FIG. 3 associated with the accumulated dump valve solenoid until the timer reaches 3,000 milliseconds (three seconds).

In a preferred embodiment, a wireless communication device is incorporated with said digital control system, wherein said wireless communication device sends fault data to a remote location. At said remote location, said fault data is reviewed by technicians who can respond to malfunctions and advise operators to repair said malfunctions remotely.

The exemplary embodiments shown in the figures and described above illustrate but do not limit the invention. It should be understood that there is no intention to limit the invention to the specific form disclosed; rather, the invention is to cover all modifications, alternative constructions, and equivalents falling within the spirit and scope of the invention as defined in the claims. For example, while the exemplary embodiments illustrate the control and monitoring of concrete pumps, the invention is not limited to use with the concrete industry and may be used with other pumping apparatuses. While the invention is not limited to use with concrete pumps, it is expected that various embodiments of the invention will be particularly useful in such devices. Hence, the foregoing description should not be construed to limit the scope of the invention, which is defined in the following claims.

While there is shown and described the present preferred embodiment of the invention, it is to be distinctly understood that this invention is not limited thereto but may be variously embodied to practice within the scope of the following claims. From the foregoing description, it will be apparent that various changes may be made without departing from the spirit and scope of the invention as defined by the following claims.

What is claimed is:

1. A digital control system for, use with a concrete pumping system having at least one power source for driving at least one hydraulic pump which is operatively connected through solenoid controlled valves to at least one concrete pump, which comprises:

a microcontroller for sensing open or short circuit conditions for the solenoids which control said solenoid controlled valves that are operatively connect the at least one hydraulic pump to the at least one concrete pump;

a plurality of comparator switch circuits interfaced with said solenoid controlled valves, wherein said comparator switch circuits are configured to send solenoid controlled valve condition status data to said microcontroller; and means for visually displaying said conditions.

2. The digital control system of claim 1, wherein said means for visually displaying said conditions displays the status of said solenoids to be an open circuit fault, if said solenoids are determined to be in an open circuit condition.

3. The digital control system of claim 1, wherein said means for visually displaying said conditions displays the status of said solenoids to be a short circuit fault, if said solenoids are determined to be in a short circuit condition.

4. The digital control system of claim 1, said digital control system comprises a motorized flow control valve, controlled by said microcontroller, wherein said motorized flow control valve is configured to modulate the flow of hydraulic fluid to said hydraulic pump.

5. The digital control system of claim 4, wherein said microcontroller is configured to control the flow of current to said solenoid based upon the monitored condition of said solenoid.

6. The digital control system of claim 4, wherein said microcontroller is configured to close said motorized flow control valve for a predetermined period of time, post activation of said microcontroller.

7. The digital control system of claim 4, wherein said microcontroller is configured to close said motorized flow control valve for a predetermined period of time, post activation of said power source.

8. The digital control system of claim 1, wherein said microcontroller is configured to activate at least one solenoid controlled valve for a predetermined period of time, post activation of said power source.

9. A digital control system for, use with a concrete pumping system having at least one power source for driving at least one hydraulic pump which is operatively connected through solenoid controlled valves to at least one concrete pump, which comprises:

a microcontroller for sensing open or short circuit conditions for the solenoids which control said solenoid controlled valves that are operatively connect the at least one hydraulic pump to the at least one concrete pump;

a motorized flow control valve attached to said concrete pumping system, wherein said motorized flow control valve is configured to modulate the flow of hydraulic fluid to said hydraulic pump;

a plurality of comparator switch circuits interfaced with said solenoid controlled valves, wherein said comparator switch circuits are configured to send solenoid controlled valve condition status data to said microcontroller;

a timing unit interfaced with said microcontroller, wherein said microcontroller generates clock pulses to determine if initial temporal conditions are established prior to the operational activation of said pump; and means for visually displaying said conditions.

10. The digital control system of claim 9, wherein said microcontroller is configured to deactivate at least one of said plurality of comparator switch circuits if a short circuit condition is sensed within at least one said solenoid.

11. The digital control system of claim 9, wherein said microcontroller is configured to close said motorized flow control valve for a predetermined period of time, post activation of said microcontroller.

12. The digital control system of claim 9, wherein said microcontroller is configured to close said motorized flow control valve for a predetermined period of time, post activation of said power source.

13. The digital control system of claim 9, wherein said microcontroller is configured to activate at least one solenoid controlled valve for a predetermined period of time, post activation of said power source.

* * * * *